US010054272B2

(12) United States Patent
Fieberg et al.

(10) Patent No.: US 10,054,272 B2
(45) Date of Patent: Aug. 21, 2018

(54) APPARATUS, SYSTEMS AND METHODS FOR A MULTICHANNEL WHITE LIGHT ILLUMINATION SOURCE

(71) Applicant: PHILIPS LIGHTING HOLDING B.V., Eindhoven (NL)

(72) Inventors: Dirk Fieberg, Groton, MA (US); Nadezhda Piskun, Sudbury, MA (US); Robert Piccirillo, Winchester, MA (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 766 days.

(21) Appl. No.: 14/385,781

(22) PCT Filed: Mar. 11, 2013

(86) PCT No.: PCT/IB2013/051913
§ 371 (c)(1),
(2) Date: Sep. 17, 2014

(87) PCT Pub. No.: WO2013/140296
PCT Pub. Date: Sep. 26, 2013

(65) Prior Publication Data

US 2015/0029713 A1 Jan. 29, 2015

Related U.S. Application Data

(60) Provisional application No. 61/612,562, filed on Mar. 19, 2012.

(51) Int. Cl.
*F21V 9/00* (2018.01)
*F21K 99/00* (2016.01)
(Continued)

(52) U.S. Cl.
CPC ..... *F21K 9/56* (2013.01); *F21K 9/64* (2016.08); *H05B 33/086* (2013.01);
(Continued)

(58) Field of Classification Search
CPC ..... A61B 5/021; A61B 5/024; A61B 5/16; H04N 21/42201; H04N 21/4394;
(Continued)

(56) References Cited

U.S. PATENT DOCUMENTS 5,803,579 A * 9/1998 Turnbull ..... B60L 1/14 257/E25.02
6,016,038 A 1/2000 Mueller et al.
(Continued)

FOREIGN PATENT DOCUMENTS

EP 1610593 A2 12/2005
EP 2211083 A1 7/2010
(Continued)

*Primary Examiner* — Tsion Tumebo
(74) *Attorney, Agent, or Firm* — Meenakshy Chakravorty

(57) ABSTRACT

An illumination source includes a housing (101), at least one first light emitting diode (LED) (102) coupled to the housing and configured to emit green-shifted white light, at least one second LED (104) coupled to the housing and configured to emit blue-shifted white light, and at least one third LED (106) coupled to the housing and configured to emit at least one of a red-orange light and an amber light.

20 Claims, 5 Drawing Sheets

(51) Int. Cl.

| | |
|---|---|
| ***H05B 33/08*** | (2006.01) |
| ***F21K 9/64*** | (2016.01) |
| *F21S 8/00* | (2006.01) |
| *F21Y 115/10* | (2016.01) |
| *F21Y 113/13* | (2016.01) |

(52) U.S. Cl.
CPC ..... *H05B 33/0857* (2013.01); *F21S 8/00* (2013.01); *F21Y 2113/13* (2016.08); *F21Y 2115/10* (2016.08)

(58) Field of Classification Search
CPC ..... H04N 21/44008; H04N 21/44218; H04N 21/4788; H04N 21/84
USPC ..... 362/231
See application file for complete search history.

(56) References Cited

U.S. PATENT DOCUMENTS

| | | | | |
|---|---|---|---|---|
| 6,211,626 | B1 | 4/2001 | Lys et al. | |
| 7,354,172 | B2 * | 4/2008 | Chemel | H05B 33/0842 362/231 |
| 7,710,369 | B2 * | 5/2010 | Dowling | G03G 15/0435 345/83 |
| 8,333,631 | B2 * | 12/2012 | Emerson | H01L 25/0753 313/503 |
| 2004/0105261 | A1 * | 6/2004 | Ducharme | H05B 33/0857 362/231 |
| 2009/0002604 | A1 * | 1/2009 | Morimoto | F21V 23/00 349/71 |
| 2010/0110672 | A1 | 5/2010 | Durand et al. | |
| 2011/0279015 | A1 * | 11/2011 | Negley | F21K 9/137 313/501 |
| 2012/0001555 | A1 * | 1/2012 | Tu | F21V 7/0008 315/161 |
| 2012/0092850 | A1 * | 4/2012 | Pickard | F21V 9/16 362/84 |
| 2014/0055982 | A1 * | 2/2014 | Tao | F21V 9/16 362/84 |

FOREIGN PATENT DOCUMENTS

| | | | |
|---|---|---|---|
| GB | 2456123 | A | 7/2009 |
| JP | 2009123429 | A | 6/2009 |
| WO | 2009158514 | A1 | 12/2009 |
| WO | 2010069933 | A2 | 6/2010 |
| WO | 2012166904 | A1 | 12/2012 |

* cited by examiner

APPARATUS, SYSTEMS AND METHODS FOR A MULTICHANNEL WHITE LIGHT ILLUMINATION SOURCE

CROSS-REFERENCE TO PRIOR APPLICATIONS

This application is the U.S. National Phase application under 35 U.S.C. § 371 of International Application No. PCT/IB13/051913, filed on Mar. 11, 2013, which claims the benefit of U.S. Provisional Patent Application No. 61/612,562, filed on Mar. 19, 2012. These applications are hereby incorporated by reference herein.

TECHNICAL FIELD

The present invention is directed generally to apparatus and methods of providing illumination using LED light sources. More particularly, various inventive apparatus, systems and methods disclosed herein relate to the generation of multichannel white light at points that are near a black body locus.

BACKGROUND

Digital lighting technologies, i.e., illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue (RGB), as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

White light can be produced by mixing different colors of light generated using multiple LEDs. There are several techniques for characterizing white light. In one technique, color temperature is used as a measure of the color of light within a range of light having white characteristics. A correlated color temperature (CCT) of the light represents the temperature in degrees Kelvin (K) of a black body radiator which radiates the same color light as the light being characterized.

Another technique for characterizing white light relates to the quality of the light. In 1965 the Commission Internationale de l'Eclairage (CIE) recommended a method for measuring the color rendering properties of light sources based on a test color sample method. This method has been updated and is described in the CIE 13.3-1995 technical report "Method of Measuring and Specifying Colour Rendering Properties of Light Sources." In essence, this method involves the spectroradiometric measurement of the light source under test. This data is multiplied by the reflectance spectrums of eight color samples. The resulting spectrums are converted to tristimulus values based on the CIE 1931 standard observer. The shift of these values with respect to a reference light are determined for the uniform color space (UCS) recommended in 1960 by the CIE. The average of the eight color shifts is calculated to generate the General Color Rendering Index, known as CRI. Within these calculations the CRI is scaled so that a perfect score equals 100, where perfect would be using a source spectrally equal to the reference source (often sunlight or full spectrum white light). For example, a tungsten-halogen source compared to full spectrum white light might have a CRI of 99 while a warm white fluorescent lamp would have a CRI of 50. Artificial lighting generally uses the standard CRI to determine the quality of white light. If a light yields a high CRI compared to full spectrum white light, then it is considered to generate better-quality white light.

The CCT and CRI of light can affect the way in which an observer perceives colors in the observer's environment. An observer will perceive the same environment differently when viewed under lights producing different correlated color temperatures. For example, an environment that looks normal when viewed in early morning sunlight will look bluish and washed out when viewed under overcast midday skies. Further, white light with a poor CRI may cause colored surfaces to appear distorted or unappealing to the observer.

Due to the differences in perception of an environment under different lighting conditions, the color temperature and/or CRI of light may be critical to creators or curators of particular environments. Examples include architects for buildings, artists for galleries, stage directors for theaters, etc. Additionally, the color temperature of artificial light affects how observers perceive a display, such as a retail or marketing display, by altering the perceived color of items such as fruits and vegetables, clothing, furniture, automobiles, and other products containing visual elements that can greatly affect how people view and react to such displays. One example is a tenet of theatrical lighting design that strong green light on the human body (even if the overall lighting effect is white light) tends to make the human look unnatural, creepy, and often a little disgusting. Thus, variations in the color temperature of lighting can affect how appealing or attractive such a display may be to observers.

Moreover, the ability to preview a decoratively colored item, such as fabric-covered furniture, clothing, paint, wallpaper, curtains, etc., in a lighting environment or at a color temperature that matches or closely approximates the conditions under which the item will ultimately be viewed by others would permit such items to be more accurately matched and coordinated. Typically, the lighting used in a display setting, such as a showroom, cannot be varied and is often chosen to highlight a particular facet of the color of the item, leaving a purchaser to guess as to whether the item in question will retain an attractive appearance under the lighting conditions where the item will eventually be placed. Differences in lighting can also leave a customer wondering whether the color of the item will clash with other items that cannot conveniently be viewed under identical lighting conditions or otherwise directly compared.

Some multichannel LED fixtures that produce white light allow a user to control the color temperature of light generated by the LED fixture by adjusting the brightness of each individual LED in the LED fixture. To adjust the characteristics of the white light, the LED fixture must have the capability of recreating various correlated color temperatures. Typically, this has been accomplished by using multiple white LEDs having different CCTs, or by combining multiple color LEDs, such as red, green, and blue to generate a desired white color. However, LED fixtures that use prime colors, such as red, green and blue, produce saturated light that cannot generate all colors in the gamut. Such fixtures also do not allow high granularity of control due to the large size of the gamut. In addition, a fixture with multiple discrete white LEDs having different CCTs will have a very small gamut along the black body. As a result, the fixture will not be able to generate all white color points on the black body locus.

Moreover, it is known that the human eye does not perceive "true" white light as white points on the black body locus. Rather, the human eye perceives "true" white light as white points above and below the black body locus, depending on the CCT of the light. Conventional discrete white LED fixtures are unable to compensate for individual color perception (hue) along the CCT isothermal lines above and below the black body locus because they cannot produce light at the "true" white color points. Thus, conventional white LED fixtures do not correct for perception of "true" white by the human eye.

As discussed above, a high CRI equates to a high quality of light. Conventional multichannel LED fixtures are incapable of generating high CRI values across a broad range of color temperatures, e.g., between approximately 2700° K and 6500° K. For example, conventional white LED fixtures can only generate CRI values of 82 or less across this range of color temperatures. Conventional RGB fixtures perform even worse, with CRI values no greater than 33 across a similar range of color temperatures.

A conventional RGB LED fixture may encompass the entire black body, but due to the limitations in efficiency of the individual LEDs used to generate the light at various points along the black body, the overall efficiency of the system is poor. For example, the efficiency of one conventional RGB LED fixture is approximately 40-42 lumens/watt across the above-mentioned range of color temperatures. A conventional white LED fixture achieves between 38 and 56 lumens/watt across the same range of color temperatures. There are existing fixtures that utilize a combination of red-shifted white LEDs and green-shifted white LEDs to generate white light at higher efficiencies than white LEDs of the same color temperature. However, this combination doesn't allow the color and hue to be tuned as discussed above to correct for perception of "true" white.

Another important consideration for adjustable illumination sources is the lumen output across the gamut, which relates to the efficiency as well as the quality of the light produced. However, conventional white LED and RGB LED fixtures may produce less than 350 lumens over an approximately 2700° K to 6500° K range of color temperatures.

Thus, there is a need in the art to provide a multichannel white light source of illumination capable of true generation of all white color points on or near the back body locus within the gamut that can be optimized for high CRI across a broad range of color temperatures and provide greater overall system efficiency and light output, and that may optionally overcome one or more drawbacks with existing solutions.

SUMMARY

The present disclosure is directed to inventive apparatus, systems and methods for producing white light having an expanded gamut and enhanced color quality, including true correlated color temperature over the black body locus, an enhanced color rendering index, improved efficiency and the capability of generating true white color points as perceived by the human eye. Applicants have recognized and appreciated that conventional multichannel lighting techniques can be improved by employing at least one green-shifted white LED, at least one blue-shifted white LED, and at least one LED that provides a red component (e.g., red-orange and/or amber), in combination with a multichannel lighting control system.

Generally, in one aspect, an illumination source includes a housing, at least one first light emitting diode (LED) coupled to the housing and configured to emit green-shifted white light, at least one second LED coupled to the housing and configured to emit blue-shifted white light, and at least one third LED coupled to the housing and configured to emit at least one of a red-orange light and an amber light.

In some embodiments, the first LED includes a first blue-pump LED having a phosphor configured to emit green-shifted white light. In accordance with one embodiment, the green-shifted white light has CIE 1931 chromaticity coordinates (x, y) within a first region defined by coordinates (0.31, 0.36), (0.34, 0.35), (0.40, 0.54) and (0.42, 0.52). In further embodiments, the second LED includes a second blue-pump LED having a phosphor configured to emit blue-shifted white light. According to one embodiment, the blue-shifted white light has CIE 1931 chromaticity coordinates (x, y) within a second region defined by coordinates (0.278, 0.250), (0.292, 0.270), (0.245, 0.285) and (0.267, 0.320). In versions of these embodiments, each of first blue-pump LED and the second blue-pump LED is free of red phosphor.

In one embodiment, the third LED is configured to emit red-orange light having a wavelength of approximately 610 nanometers. In another embodiment, the third LED is configured to emit amber light having a wavelength of approximately 590 nanometers.

In one embodiment, the illumination source further comprises a controller coupled to a combination of the first LED, the second LED and the third LED. The controller is configured to variably adjust a light output of the combination so as to generate light corresponding to at least one of a plurality of points near a black body locus in a range of correlated color temperatures (CCT) between approximately 2,400K and 6,500K. In some embodiments, the combination of the first LED, the second LED and the third LED is configured to generate white light adjustable within each of a plurality of ANSI quadrangles including CCT ranges from approximately 2,400K to 6,500K along the black body locus while maintaining an efficiency of greater than 60 lumens/watt. In other embodiments, the combination of the first LED, the second LED and the third LED is configured to generate white light adjustable within each of a plurality of ANSI quadrangles including CCT ranges from approximately 2,400K to 6,000K along the black body locus while maintaining a color rendering index (CRI) of greater than 85. In yet another embodiment, the combination of the first LED, the second LED and the third LED is configured to generate white light adjustable within each of a plurality of ANSI quadrangles including CCT ranges from approximately 2,400K to 5,000K while maintaining an output of greater than 500 lumens.

In one aspect, a method of generating light includes generating white light using an illumination source including at least one first light emitting diode (LED) configured to emit green-shifted white light, at least one second LED configured to emit blue-shifted white light, and at least one third LED configured to emit at least one of red-orange light and amber light. The generated white light corresponds to at least one of a plurality of points near a black body locus.

In one embodiment, the method further includes generating the green-shifted white light having CIE 1931 chromaticity coordinates (x, y) within a first region defined by coordinates (0.31, 0.36), (0.34, 0.35), (0.40, 0.54) and (0.42, 0.52). In another embodiment, the method further comprises generating the blue-shifted white light having CIE 1931 chromaticity coordinates (x, y) within a second region defined by coordinates (0.278, 0.250), (0.292, 0.270), (0.245, 0.285) and (0.267, 0.320).

In one embodiment, the method further includes generating variably adjustable white light in a range of correlated color temperatures (CCT) between approximately 2,400K and 6,500K. In further embodiments, the method further comprises generating white light adjustable within each of a plurality of ANSI quadrangles including CCT ranges from approximately 2,400K to 6,500K along the black body locus while maintaining an efficiency of greater than 60 lumens/watt. In another optional embodiment, the method further comprises generating white light adjustable within each of a plurality of ANSI quadrangles including CCT ranges from approximately 2,400K to 6,000K along the black body locus while maintaining a color rendering index (CRI) of greater than 85. In yet another optional embodiment, the method further comprises generating white light adjustable within each of a plurality of ANSI quadrangles including CCT ranges from approximately 2,400K to 5,000K with an output of greater than 500 lumens. The method can also further comprise variably generating the white light corresponding to any of the plurality of points near the black body locus using the combination of the at least one first LED, the at least one second LED and the at least one third LED.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

As used herein, the term "blue-pump LED" refers to an LED configured to generate blue light. In some embodiments, a blue-pump LED may include a phosphor material (e.g., disposed on a lens) that alters the color of light emitted by the blue-pump LED, for example, to generate green-shifted white light or blue-shifted white light. In some embodiments, the phosphor(s) employed in the blue-pump LED are free of red phosphors.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, etc.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

The terms "lighting fixture" or "luminaire" are used herein interchangeably to refer to an implementation or arrangement of one or more lighting units or a plurality of light sources in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multichannel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller that employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

As discussed above, one important characteristic of a multichannel LED fixture, in combination with a multichannel lighting control system, is the ability to generate white light at various color points along or near a black body within a large gamut. Applicants have recognized and appreciated that an LED fixture having at least one green-shifted white LED, at least one blue-shifted white LED, and at least one third LED that provides a red component (e.g., red-orange and/or amber) can provide illumination at all or nearly all white color points with hues that correct for the perception of white by the human eye. Such a fixture can further provide high CRI across a broad range of color temperatures with greater overall system efficiency and light output than conventional LED fixtures. In view of the foregoing, various embodiments and implementations of the present invention are directed to apparatus, systems and methods for generating multichannel white light as a source of illumination.

Figure 1:
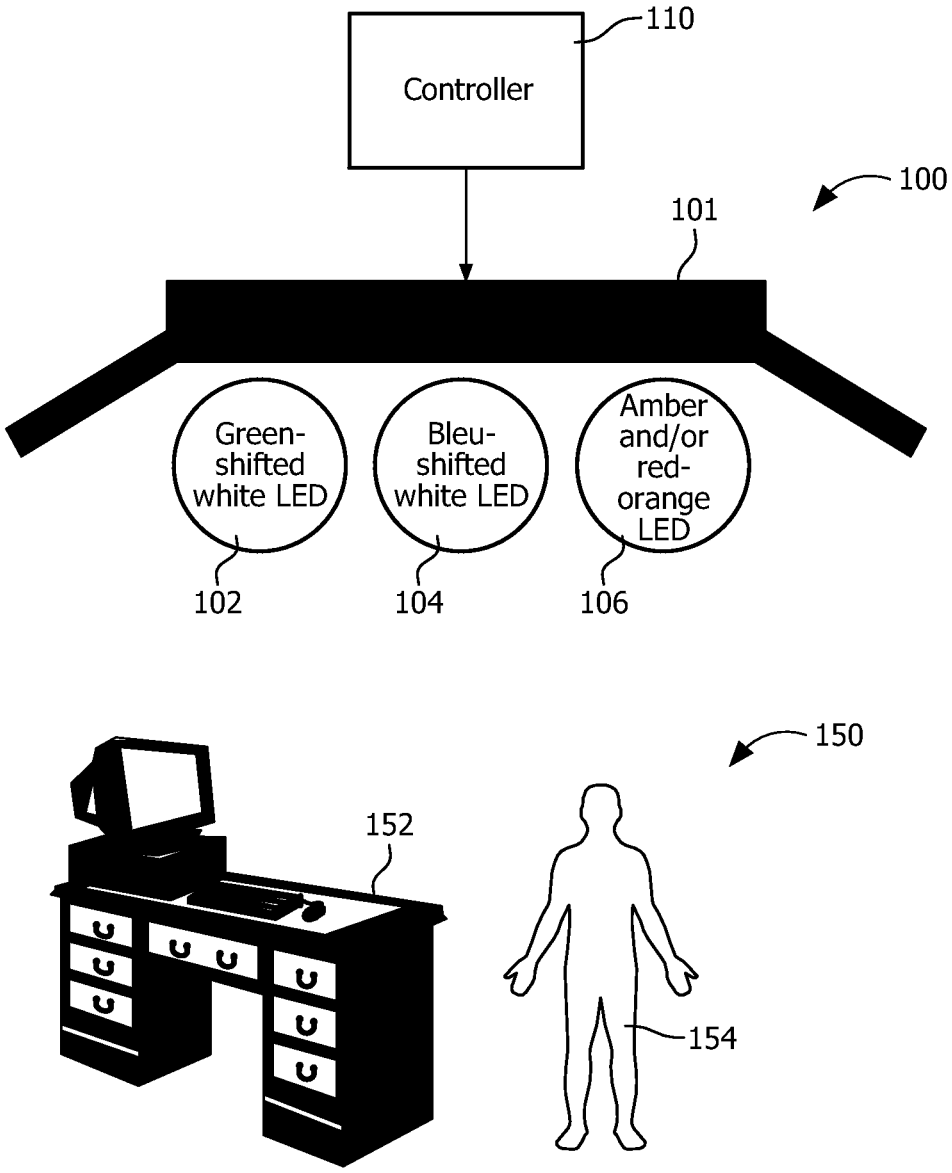
FIG. 1 illustrates a block diagram of a multichannel white light source of illumination in accordance with one embodiment.

FIG. 1 is a block diagram depicting an LED fixture 100, according to one embodiment. The LED fixture 100 includes a housing 101 and a plurality of LEDs mounted to the housing, including at least one green-shifted white LED 102, at least one blue-shifted white LED 104 and at least one amber and/or red-orange LED 106. The green-shifted white LED 102 may include a blue LED (also referred to as a blue-pump LED) having a phosphor configured to emit green-shifted white light. The blue-shifted white LED 104 may include a blue-pump LED having a phosphor configured to emit blue-shifted white light. The LED fixture 100 may further include a controller 110 for controlling the light output by each LED 102, 104, 106. In some embodiments, the LED fixture 100 is configured to illuminate an environment 150, such as an office (e.g., as represented by a desk 152), auditorium, foyer, theater, retail store, studio, gallery, etc., and particularly environments in which accurate color perception by the human eye 154 is desirable. In various embodiments, the LEDs 102, 104, 106 are arranged within the LED fixture 100 such that the light emitted from each LED 102, 104, 106 mixes in an additive manner to produce light of a particular color (e.g., white light).

In some embodiments, the controller 110 is configured to variably control the illumination generated by the LED fixture 100, for example, by controlling the intensity or brightness of each LED 102, 104, 106 independently of the other LEDs in the fixture. Such variable control may be used to produce illumination of any color within the spectra of each LED 102, 104, 106, either individually or in combination with one another or in combination with additional LEDs having the same or different spectra. In some other embodiments, the illumination generated by the LED fixture 100 may be fixed or non-adjustable. In one embodiment, multiple LED fixtures 100 may be combined or arranged in a manner that allows the controller 110 to provide a common control for the fixture. For example, multiple LED fixtures 100 can be employed to illuminate the environment 150 and the controller 150 can be configured to control the LED fixtures 100 independently or collectively to provide the desired illumination in the environment 150.

Figure 2:
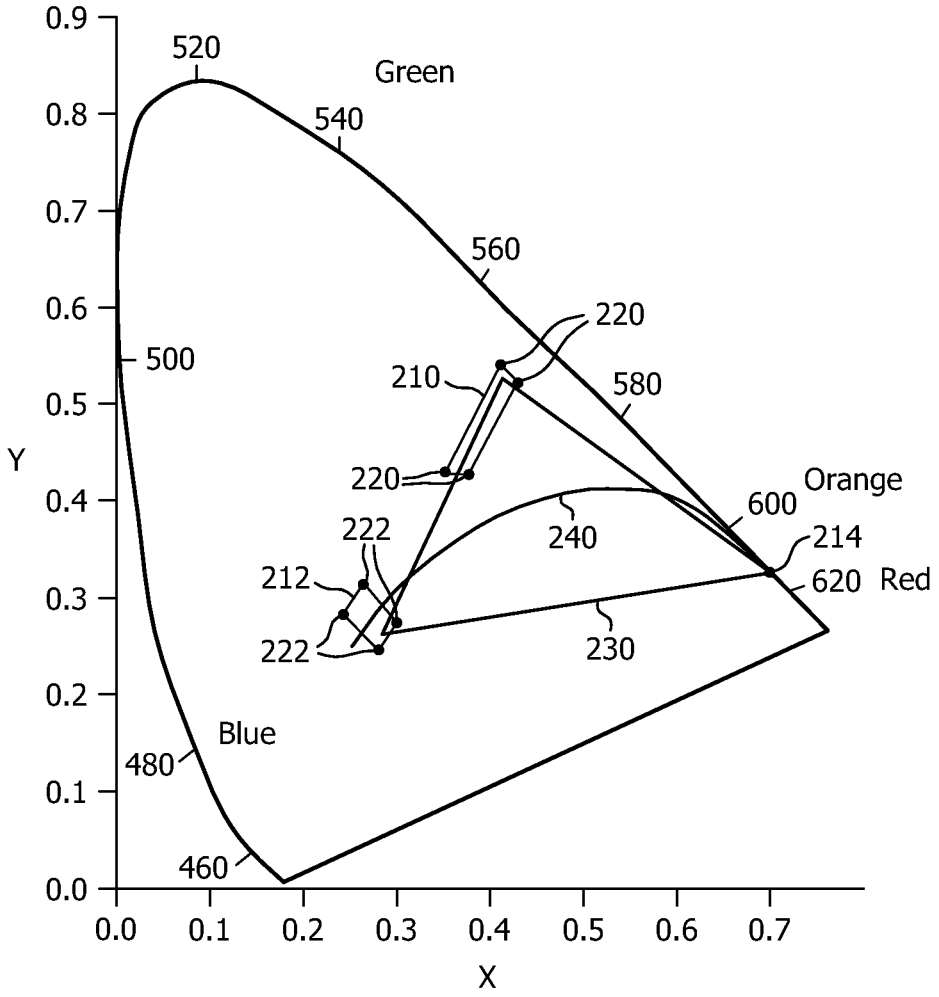
FIG. 2 is a CIE 1931 chromaticity diagram illustrating a gamut produced by a multichannel white light source of illumination in accordance with one embodiment.

FIG. 2 is a CIE 1931 chromaticity diagram illustrating one example of a gamut 230 produced by a multichannel LED fixture, such as the LED fixture 100 of FIG. 1, in accordance with one embodiment. As discussed above, the LED fixture 100 may include at least one green-shifted white LED 102, at least one blue-shifted white LED 104, and at least one third LED 106. In the illustrated embodiment, the blue-shifted white LED 104 is configured to generate light within a first range of CIE coordinates 210, and the green-shifted white LED 102 is configured to generate light within a second range of CIE coordinates 212. In one embodiment, the third LED 106 is configured to generate red-orange light at or about a point 214 on the chromaticity diagram (e.g., at or near a wavelength of 690 nanometers). In some embodiments, the third LED 106 is configured to generate one or more different colors of light, for example, amber (such as described below with respect to FIG. 3). A red-orange and/or amber component can be used in the third LED 106 to expand the gamut, because, in some embodiments, the green-shifted white LED 102 and the blue-shifted white LED 104 do not contain any red phosphor. An LED free of red phosphor can be advantageous because it allows a more efficient generation of the desired LED output, for example, the generation of light corresponding to the chromaticity coordinates that are described below.

The first range of CIE coordinates 210 may have CIE 1931 chromaticity coordinates (x,y) within a range bounded by points 220 on the CIE 1931 chromaticity diagram, and the second range of CIE coordinates 212 may have CIE 1931 chromaticity coordinates (x,y) within a range bounded by points 222. One example of coordinates corresponding to points 220 and 222 is shown in Table 1 below.

TABLE 1

CIE 1931 Chromaticity Coordinates (x, y).

| | Green-shifted White points 222 | | Blue-shifted White points 220 | |
|---|---|---|---|---|
| | Chromaticity x | Chromaticity y | Chromaticity x | Chromaticity y |
| Lower Left | 0.31 | 0.36 | 0.278 | 0.250 |
| Lower Right | 0.34 | 0.35 | 0.292 | 0.270 |
| Upper Left | 0.40 | 0.54 | 0.245 | 0.285 |
| Upper Right | 0.42 | 0.52 | 0.267 | 0.320 |

As mentioned above, the gamut 230 corresponds to light generated by the combination of the blue-shifted white LED 104, the green-shifted white LED 102, and the red-orange LED 106. The black body locus is shown by line 240. As can be seen, the gamut 230 includes much of the black body locus 240, meaning that the LED fixture 100 of the present embodiment is capable of producing light across a wide range of color temperatures along and near the black body 240.

Figure 3:
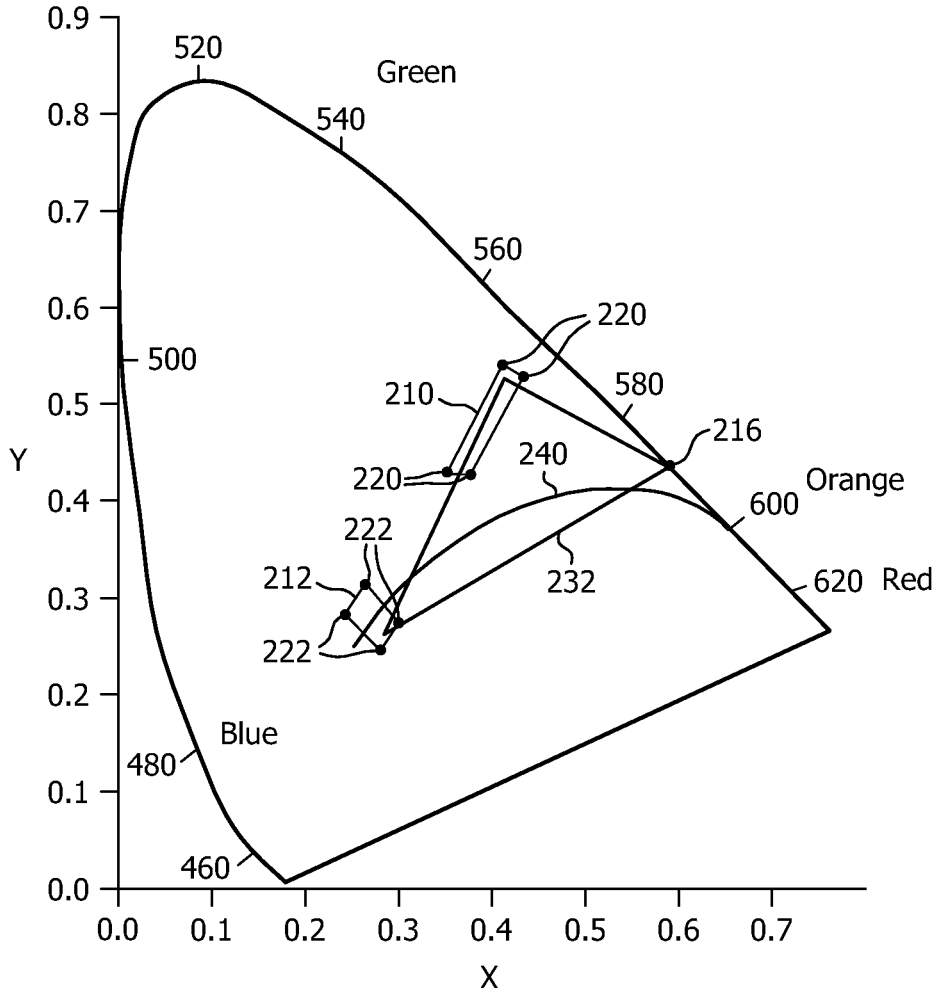
FIG. 3 is a CIE 1931 chromaticity diagram illustrating a gamut produced by a multichannel white light source of illumination in accordance with another embodiment.

Referring now to FIG. 3, a CIE 1931 chromaticity diagram illustrating an example of a gamut 232 produced by a multichannel LED fixture, such as the LED fixture 100 of FIG. 1, is shown in accordance with another embodiment. The present embodiment is substantially similar to the embodiment discussed above with respect to FIG. 2, except that the third LED 106 is configured to generate amber light at or about a point 216 on the chromaticity diagram (e.g., at or near a wavelength of 590 nanometers). The gamut 232 corresponds to the light generated by a combination of the blue-shifted white LED 104, the green-shifted white LED 102, and the amber LED 106. Here too, the gamut 232 includes much of the black body locus 240, which allows the LED fixture 100 of the present embodiment to produce light across a wide range of color temperatures along and near the black body 240. In other embodiments, different light channels and/or additional light channels may be used to expand the gamut.

Figure 4:
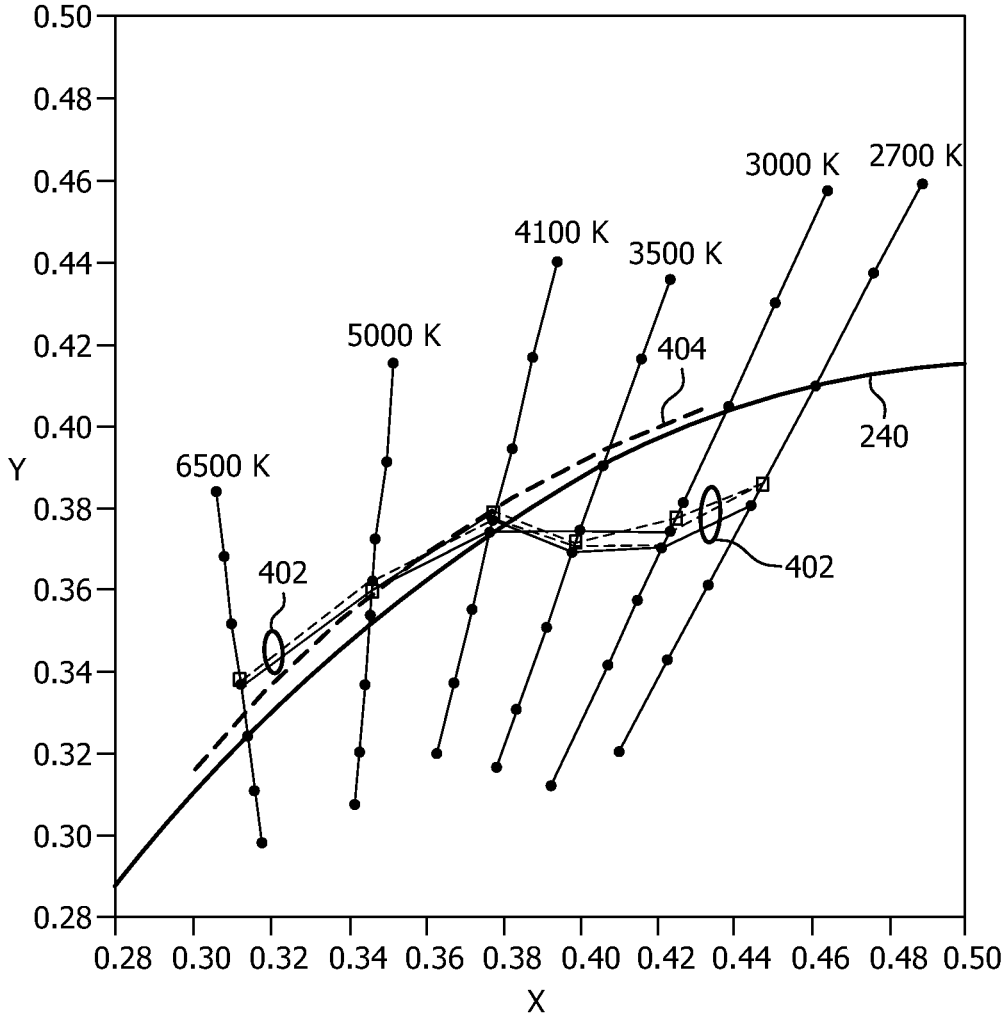
FIG. 4 is a CIE 1931 chromaticity diagram showing several points corresponding to white light as corrected for perception by the human eye at various correlated color temperatures.

As discussed above, the human eye does not perceive white light as the white points on the black body locus, but rather perceives white points above and below the black body locus depending on the CCT that is being observed. FIG. 4 illustrates a CIE 1931 chromaticity diagram showing a series of "true" white light lines 402 connecting white points above and below the black body 240. The chromaticity diagram of FIG. 4 also includes a daylight locus 404 representing the hue of average natural daylight at various correlated color temperatures. Each of the points along the true white lines 402 represent the hue of white light at various color temperatures, corrected for perception by the human eye. At isothermally equivalent points between approximately 2700° K and 4100° K, the true white line 402 is below the black body 240. Between approximately 4100° K and 5000° K, the true white line 402 is above the black body 240 and approximately parallels the daylight locus 404. Above approximately 4100° K, the true white line 402 is above both the black body 240 and the daylight locus 404. It is appreciated that all of the color points along the true white line 402 cannot be achieved using a conventional white LED fixture. In contrast, the LED fixture of at least one embodiment is capable of producing all of the color points along the true white line 402 between approximately 2700° K and 6500° K.

Figure 5:
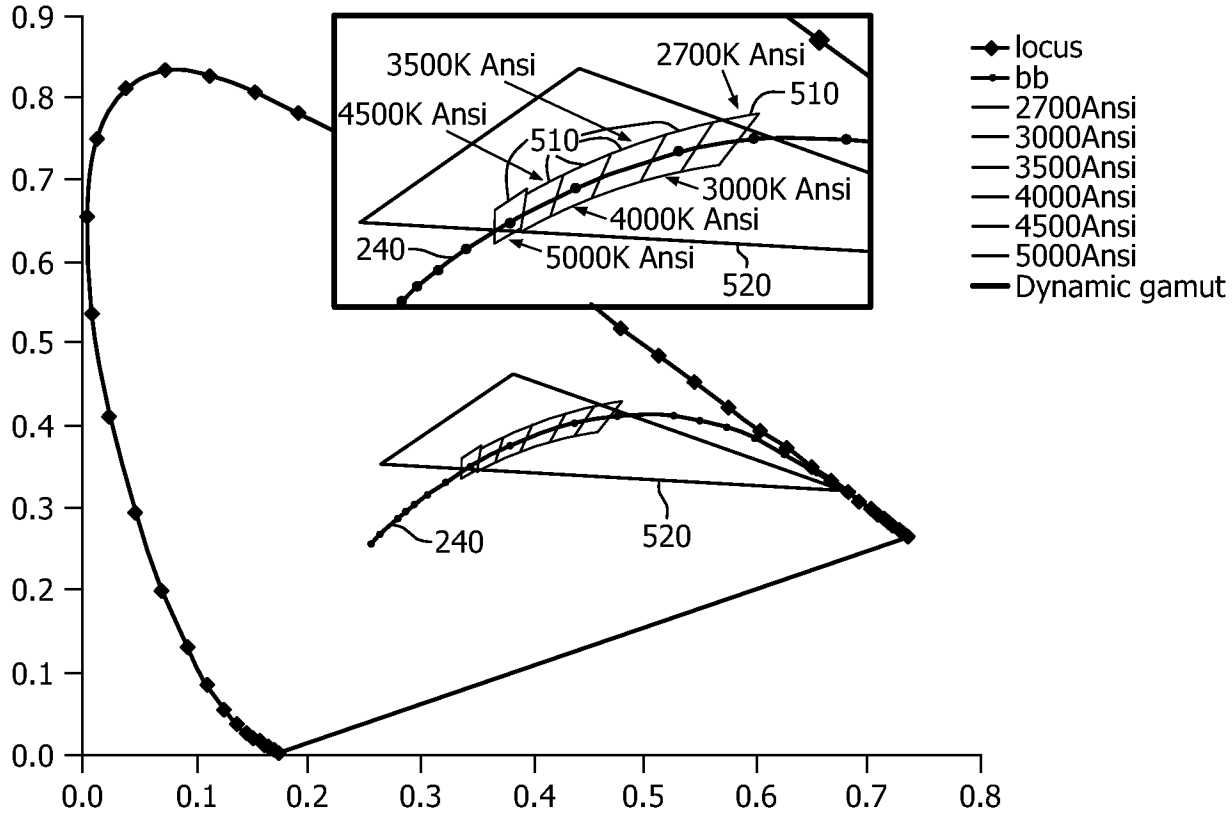
FIG. 5 is a CIE 1931 chromaticity diagram illustrating a gamut produced by a multichannel white light source of illumination in accordance with yet another embodiment.

The color of light generated by an LED can be characterized on a CIE 1931 chromaticity diagram with respect to a series of nominal CCT quadrangles (also referred to as "ANSI quadrangles") as specified by the ANSI C78.377 standard. ANSI quadrangles are used to specify a range of (x,y) coordinates on the CIE 1931 chromaticity diagram around a standard color temperature. As will be understood by one of skill in the art, ANSI quadrangles may be used as a tolerance specification to characterize the color temperature generated by an LED. FIG. 5 illustrates a CIE 1931 chromaticity diagram showing various ANSI quadrangles 510 for white light overlaid on a gamut 520 representing all colors of light that an LED fixture of at least one embodiment (e.g., LED fixture 100 of FIG. 1) is capable of generating. Line 240 represents the black body locus. As can be seen in FIG. 5, between 2700° K and 5000° K, the gamut 520 includes all white light points along the black body 240, and nearly all white light points within the ANSI quadrangles, indicating that the LED fixture is capable of generating various correlated temperatures of white light along, above and below the black body at least between 2700° K and 5000° K.

As discussed above, some embodiments are capable of producing light having a high output at a high efficiency and with a high CRI. Table 2 below provides a comparison of output, efficiency and CRI between an LED fixture (e.g., LED fixture 100 of FIG. 1) of at least one embodiment and two conventional LED fixtures. In Table 2, "RGB" refers to performance of a conventional red-green-blue LED fixture, "White" refers to performance of a conventional adjustable white light LED fixture (such as an INTELLIWHITE series of LED luminaires by Philips Solid-State Lighting Solutions, Inc., of Burlington, Mass.), and "LED 100" refers to performance of an LED fixture according to one embodiment (e.g., LED fixture 100).

TABLE 2

Comparison of Output, Efficiency and CRI.

| | RGB Lumen | White Lumen | LED 100 Lumen | RGB Lm/W | White Lm/W | LED 100 Lm/W | RGB CRI | White CRI | LED 100 CRI |
|---|---|---|---|---|---|---|---|---|---|
| 2400° K | 260 | — | 520 | 40 | — | 63 | 24 | — | 89 |
| 2700° K | 282 | 212 | 554 | 41 | 38 | 65 | 27 | 80 | 90 |
| 4000° K | 345 | 269 | 728 | 42 | 49 | 71 | 32 | 82 | 91 |
| 6500/6000° K | 344 | 312 | 405 | 41 | 56 | 65 | 33 | 75 | 90 |

As can be seen in Table 2, embodiments of the LED 100 are capable of producing, at equivalent color temperatures, a higher output (lumens), at a greater efficiency (Lm/W) and with a higher CRI than either the conventional RGB or white fixtures. Notably, the LED 100 is capable of generating light with CRI above 85, which not possible using conventional LED fixtures.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims in parentheses, if any, are provided merely for convenience and should not be construed as limiting the claims in any way.

The invention claimed is:

1. An illumination source, comprising:

a housing;

at least one first light emitting diode (LED) coupled to the housing and configured to emit green-shifted white light;

at least one second LED coupled to the housing and including a phosphor configured to emit blue-shifted white light, wherein the blue-shifted white light has CIE 1931 chromaticity coordinates (x, y) within a first region defined by coordinates (0.278, 0.250), (0.292, 0.270), (0.245, 0.285) and (0.267, 0.320); and at least one third LED coupled to the housing and configured to emit at least one of a red-orange light and an amber light.

2. The illumination source of claim 1, wherein the at least one first LED includes a first blue-pump LED having a phosphor configured to emit green-shifted white light.

3. The illumination source of claim 1, wherein the green-shifted white light has CIE 1931 chromaticity coordinates (x, y) within a second region defined by coordinates (0.31, 0.36), (0.34, 0.35), (0.40, 0.54) and (0.42, 0.52).

4. The illumination source of claim 3, wherein the at least one second LED includes a second blue-pump LED.

5. The illumination source of claim 4, wherein each of first blue-pump LED and the second blue-pump LED is free of red phosphor.

6. The illumination source of claim 3, wherein each LED of the at least one second LED is configured to independently emit the blue-shifted white light having CIE 1931 chromaticity coordinates (x, y) within the first region defined by coordinates (0.278, 0.250), (0.292, 0.270), (0.245, 0.285) and (0.267, 0.320), and wherein each LED of the at least one first LED is configured to independently emit the green-shifted white light having CIE 1931 chromaticity coordinates (x, y) within the second region defined by coordinates (0.31, 0.36), (0.34, 0.35), (0.40, 0.54) and (0.42, 0.52).

7. The illumination source of claim 1, wherein the at least one third LED is configured to emit red-orange light having a wavelength of approximately 610 nanometers.

8. The illumination source of claim 1, wherein the at least one third LED is configured to emit amber light having a wavelength of approximately 590 nanometers.

9. The illumination source of claim 1, further comprising a controller coupled to a combination of the at least one first LED, the at least one second LED and the at least one third LED, wherein the controller is configured to variably adjust a light output of the combination so as to generate light corresponding to at least one of a plurality of points near a black body locus in a range of correlated color temperatures (CCT) between approximately 2,400K and 6,500K.

10. The illumination source of claim 9, wherein the combination of the at least one first LED, the at least one second LED and the at least one third LED is configured to generate white light adjustable within each of a plurality of ANSI quadrangles including CCT ranges from approximately 2,400K to 6,500K along the black body locus while maintaining an efficiency of greater than 60 lumens/watt.

11. The illumination source of claim 9, wherein the combination of the at least one first LED, the at least one second LED and the at least one third LED is configured to generate white light adjustable within each of a plurality of ANSI quadrangles including CCT ranges from approximately 2,400K to 6,000K along the black body locus while maintaining a color rendering index (CRI) of greater than 85.

12. The illumination source of claim 1, wherein each LED of the at least one second LED is configured to independently emit the blue-shifted white light having CIE 1931 chromaticity coordinates (x, y) within the first region defined by coordinates (0.278, 0.250), (0.292, 0.270), (0.245, 0.285) and (0.267, 0.320).

13. A method of generating light, the method comprising:

generating white light using an illumination source including at least one first light emitting diode (LED) configured to emit green-shifted white light, at least one second LED with a phosphor configured to emit blue-shifted white light, and at least one third LED configured to emit at least one of red-orange light and amber light, wherein the generated white light corresponds to at least one of a plurality of points along a black body locus and wherein the blue-shifted white light has CIE 1931 chromaticity coordinates (x, y) within a first region defined by coordinates (0.278, 0.250), (0.292, 0.270), (0.245, 0.285) and (0.267, 0.320).

14. The method of claim 13, wherein the green-shifted white light has CIE 1931 chromaticity coordinates (x, y) within a second region defined by coordinates (0.31, 0.36), (0.34, 0.35), (0.40, 0.54) and (0.42, 0.52).

15. The method of claim 14, wherein each LED of the at least one second LED is configured to independently emit the blue-shifted white light having CIE 1931 chromaticity coordinates (x, y) within the first region defined by coordinates (0.278, 0.250), (0.292, 0.270), (0.245, 0.285) and (0.267, 0.320), and wherein each LED of the at least one first LED is configured to independently emit the green-shifted white light having CIE 1931 chromaticity coordinates (x, y) within the second region defined by coordinates (0.31, 0.36), (0.34, 0.35), (0.40, 0.54) and (0.42, 0.52).

16. The method of claim 13, further comprising generating variably adjustable white light in a range of correlated color temperatures (CCT) between approximately 2,400K and 6,500K.

17. The method of claim 16, further comprising generating white light adjustable within each of a plurality of ANSI quadrangles including CCT ranges from approximately 2,400K to 6,500K along the black body locus while maintaining an efficiency of greater than 60 lumens/watt.

18. The method of claim 16, further comprising generating white light adjustable within each of a plurality of ANSI quadrangles including CCT ranges from approximately 2,400K to 5,000K with an output of greater than 500 lumens.

19. The method of claim 16, further comprising variably generating the white light corresponding to any of the plurality of points along the black body locus using the combination of the at least one first LED, the at least one second LED and the at least one third LED.

20. The method of claim 13, wherein each LED of the at least one second LED is configured to independently emit the blue-shifted white light having CIE 1931 chromaticity coordinates (x, y) within the first region defined by coordinates (0.278, 0.250), (0.292, 0.270), (0.245, 0.285) and (0.267, 0.320).

* * * * *